US006382579B1

(12) United States Patent
Kenniston

(10) Patent No.: US 6,382,579 B1
(45) Date of Patent: May 7, 2002

(54) SUPPORT SYSTEM FOR AN INVERTED TOOTHPASTE TUBE

(76) Inventor: Toby W. Kenniston, 58 Oliver St., Rockland, ME (US) 04841

( * ) Notice: Subject to any disclaimer, the term of this patent is extended or adjusted under 35 U.S.C. 154(b) by 0 days.

(21) Appl. No.: 09/450,538

(22) Filed: Nov. 30, 1999

(51) Int. Cl.[7] ..... A47K 1/08

(52) U.S. Cl. ..... 248/311.3; 248/108; 248/109; 248/314

(58) Field of Search ..... 248/108, 109, 248/314, 311.3

(56) References Cited

U.S. PATENT DOCUMENTS

| | | | | | |
|---|---|---|---|---|---|
| 1,575,231 | A | * | 3/1926 | Seltmann | |
| 2,078,149 | A | * | 4/1937 | Lutz | 221/60 |
| 3,199,552 | A | * | 8/1965 | Nordfors | 141/313 |
| 3,819,194 | A | * | 6/1974 | Grevich et al. | 279/23 |
| 4,723,671 | A | * | 2/1988 | Mears | 215/228 |
| 5,033,629 | A | * | 7/1991 | Caine | 211/69.5 |
| 5,065,966 | A | * | 11/1991 | Hartke | 248/146 |
| D342,866 | S | * | 1/1994 | Lee | D7/619 |
| 5,788,194 | A | * | 8/1998 | Van Den Berg | 248/109 |
| 5,794,904 | A | * | 8/1998 | Hackley | 248/311.3 |
| 5,799,910 | A | * | 9/1998 | Dexter | 248/109 |
| 5,950,698 | A | * | 9/1999 | Cristea et al. | 141/364 |
| D426,428 | S | * | 6/2000 | Fredenberg | D7/619 |

* cited by examiner

*Primary Examiner*—Leslie A. Braun
*Assistant Examiner*—Steven Marsh

(57) ABSTRACT

Disclosed is a support system for an inverted toothpaste tube. The support system has a housing formed of a one piece plastic construction, fabricated of a rigid material selected from the class of rigid materials including plastic, ceramic and metal, preferably plastic. The housing is further provided with a flat circular lower end for being positioned securely on a counter as well as a circular upper end. A frusto-conical exterior surface is located therebetween with a central bore therethrough. The bore has a vertical central axis with the exterior surface at an angle from the vertical axis of the bore. The central bore has a cylindrical lower part of a reduced diameter and a length for receiving the toothpaste cap. The central bore also has a cylindrical upper portion of an enlarged diameter and a length to receive a lower portion of the tube. The bore also has a frusto-conical intermediate section between the upper and lower portions for receiving and supporting the shoulder.

4 Claims, 2 Drawing Sheets

FIG 3
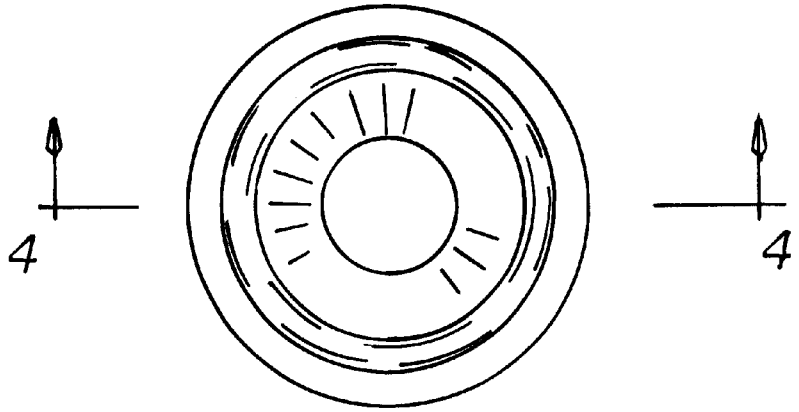
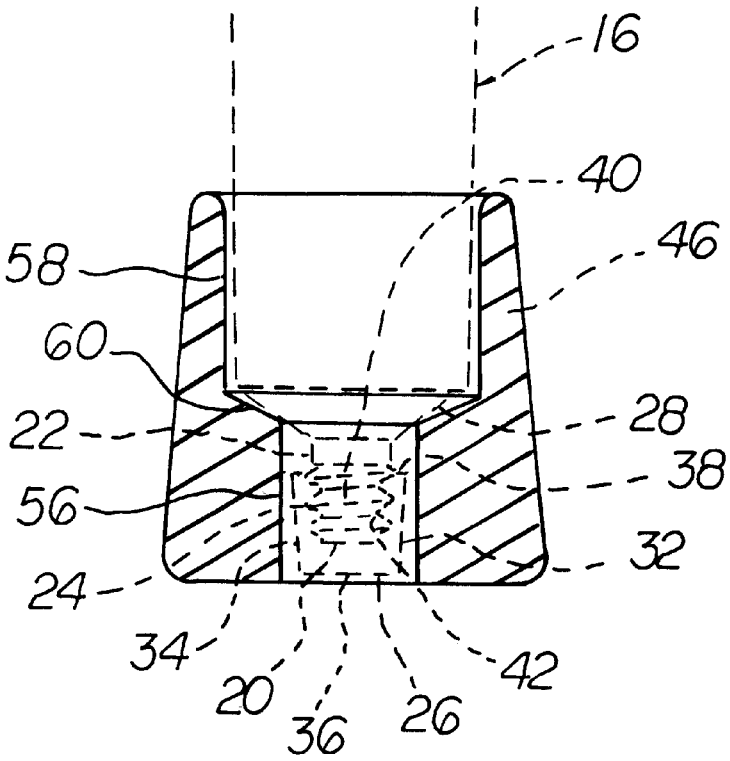
FIG 4

SUPPORT SYSTEM FOR AN INVERTED TOOTHPASTE TUBE

BACKGROUND OF THE INVENTION

1. Field of the Invention

The present invention relates to a new and improved support system for an inverted toothpaste tube and, more particularly, pertains to insuring ready dispensing of toothpaste from a supported toothpaste tube.

2. Description of the Prior Art

The use of toothpaste tubes and related devices of known designs and configurations is known in the prior art. More specifically, toothpaste tubes and related devices of known designs and configurations heretofore devised and utilized for the purpose of insuring the proper dispensing of contents from a container through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of toothpaste tubes and related devices of known designs and configurations. By way of example, U.S. Pat. No. 5,794,904 to Hackley, issued Aug. 18, 1998 discloses a holder for inverted bottles. U.S. Pat. No. 5,664,753 to Takei, issued Sep. 9, 1997 discloses a bottle or container holder for holding the bottle or container in an inverted position. U.S. Pat. No. 5,464,127 to Burrows, issued Nov. 7, 1995 discloses a sealed actuator probe assembly for a bottled water station. U.S. Pat. No. 5,009,028 to Lorenzana et al., issued Apr. 23, 1991 discloses an apparatus for supplying water continuously to tree stand. U.S. Pat. No. 4,909,401 to McConnell, issued Mar. 20, 1990 discloses a bottle washing/storage/organizing/dispensing fixture system. U.S. Pat. No. 2,091,518 to Murphy, issued Aug. 31, 1937 discloses a dispenser for liquids. U.S. Pat. No. 2,878,920 to Rayman, issued Mar. 24, 1959 discloses a universal bottle pocket. U.S. Pat. No. 1,618,821 to Gruetter, issued Feb. 22, 1927 discloses a bottle holder. Lastly, U.S. Pat. No. 139,915 to Piper, issued Jun. 17, 1873 discloses a cooler for wine.

In this respect, the support system for an inverted toothpaste tube according to the present invention substantially departs from the conventional concepts and designs of the prior art, and in doing so provides an apparatus primarily developed for the purpose of insuring ready dispensing of toothpaste from a supported toothpaste tube.

Therefore, it can be appreciated that there exists a continuing need for a new and improved support system for an inverted toothpaste tube which can be used for insuring ready dispensing of toothpaste from a supported toothpaste tube. In this regard, the present invention substantially fulfills this need.

SUMMARY OF THE INVENTION

In view of the foregoing disadvantages inherent in the known types of toothpaste tubes and related devices of known designs and configurations now present in the prior art, the present invention provides a new and improved support system for an inverted toothpaste tube. As such, the general purpose of the present invention, which will be described subsequently in greater detail, is to provide a new and improved support system for an inverted toothpaste tube and methods which have all the advantages of the prior art and none of the disadvantages.

To attain this, the present invention essentially comprises a support system for an inverted toothpaste tube to insure ready dispensing of toothpaste from therewithin comprising, in combination, a toothpaste tube having an elongated body portion formed of a deformable material with toothpaste therein for being dispensed, the body portion having a closed bottom end and an open top end, the top end including a relatively rigid neck with exterior male screw threads and an interior cylindrical bore for the passage of toothpaste from the container to exterior thereof, the toothpaste tube also having a shoulder in a generally frusto-conical orientation coupling the lower end of the body portion by its radially exterior edge and the neck at its radially interior edge; a cap formed of a relatively rigid plastic material having a frusto-conical exterior surface with a closed lower end and an open upper end and with a cylindrical recess formed with interior female screw threads therein for removably coupling with the neck of the tube; and a housing formed of a one piece plastic construction, fabricated of a rigid material selected from the class of rigid materials including plastic, ceramic and metal, preferably plastic, the housing having a flat circular lower end with a diameter of about 2.062 inches for being positioned securely on a counter and a circular upper end with a diameter of about 1.725 inches and with a frusto-conical exterior surface therebetween and with a central bore therethrough, the bore having a vertical central axis with the exterior surface at an angle of between about 5 and 10 degrees from the vertical axis of the bore, the central bore having a cylindrical lower part of a reduced diameter of about 0.75 inches and a length of about 0.875 inches for receiving the toothpaste cap and with the central bore having a cylindrical upper portion of an enlarged diameter of about 1.425 inches and a length of about 1.125 inches to receive a lower portion of the tube and with the bore having a frusto-conical intermediate section of a length of about 0.150 inches between the upper and lower portions for receiving and supporting the shoulder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved support system for an inverted toothpaste tube which has all the advantages of the prior art toothpaste tubes and related devices of known designs and configurations and none of the disadvantages.

It is another object of the present invention to provide a new and improved support system for an inverted toothpaste tube which may be easily and efficiently manufactured and marketed.

It is a further object of the present invention to provide a new and improved support system for an inverted toothpaste tube which is of a durable and reliable construction.

An even further object of the present invention is to provide a new and improved support system for an inverted toothpaste tube which is susceptible of a low cost of manufacture with regard to both materials and labor, and which accordingly is then susceptible of low prices of sale to the consuming public, thereby making such a support system for an inverted toothpaste tube economically available to the buying public.

Even still another object of the present invention is to insure the ready dispensing of toothpaste from a supported toothpaste tube.

Lastly, it is an object of the present invention to provide a support system for an inverted toothpaste tube comprising a housing formed of a one piece plastic construction, fabricated of a rigid material selected from the class of rigid materials including plastic, ceramic and metal, preferably plastic, the housing having a flat circular lower end for being positioned securely on a counter and a circular upper end and with a frusto-conical exterior surface therebetween and with a central bore therethrough, the bore having a vertical central axis with the exterior surface at an angle from the vertical axis of the bore, the central bore having a cylindrical lower part of a reduced diameter and a length for receiving the toothpaste cap and with the central bore having a cylindrical upper portion of an enlarged diameter and a length to receive a lower portion of the tube and with the bore having a frusto-conical intermediate section between the upper and lower portions for receiving and supporting the shoulder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 a top elevational view of the housing shown in FIG. 2.

FIG. 4 a cross-sectional view taken along line 4—4 of FIG. 3.

The same reference numerals refer to the same parts throughout the various Figures.

DESCRIPTION OF THE PREFERRED EMBODIMENT

Figure 1:
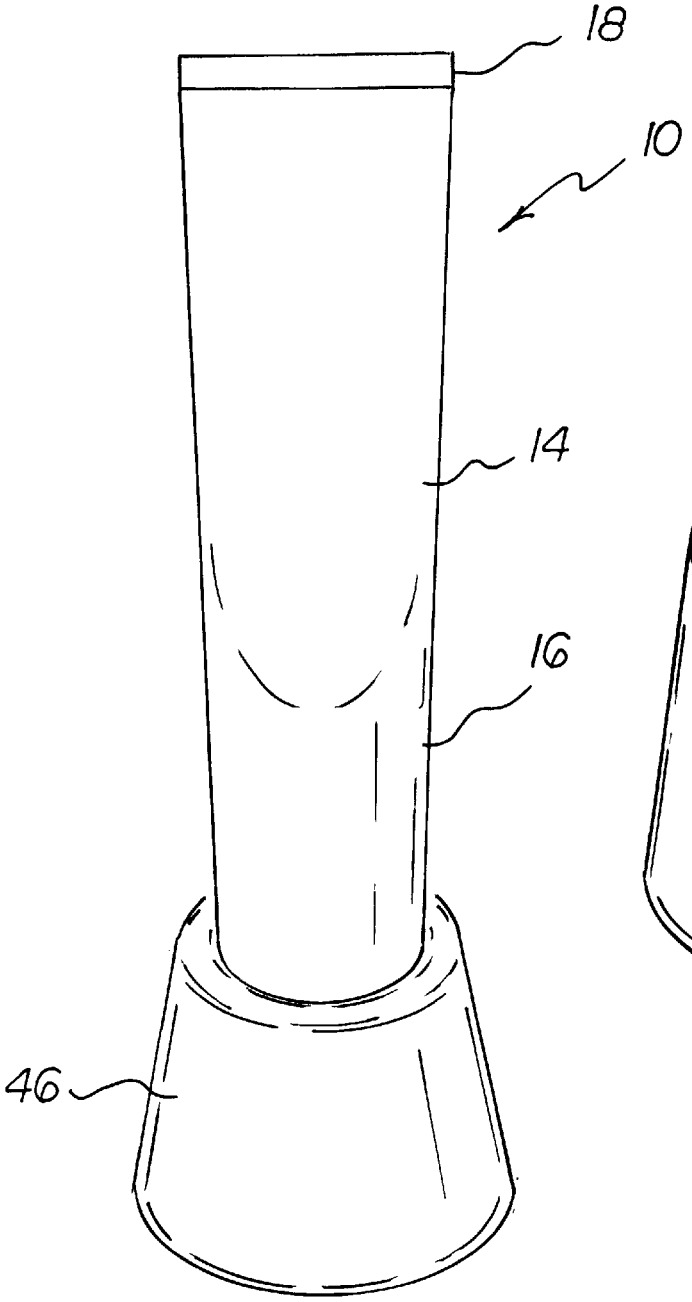
FIG. 1 is a perspective illustration of a new and improved support system for an inverted toothpaste tube.
Figure 2:
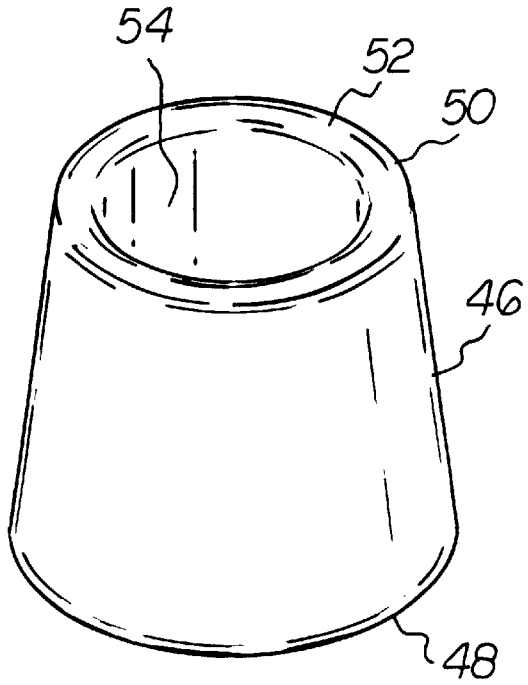
FIG. 2 an enlarged view of the housing shown in FIG. 1 but with the toothpaste tube removed.

With reference now to the drawings, and in particular to FIGS. 1 through 4 thereof, the preferred embodiment of the new and improved support system for an inverted toothpaste tube embodying the principles and concepts of the present invention and generally designated by the reference numeral 10 will be described.

The present invention, the new and improved support system for an inverted toothpaste tube, is a system 10 comprised of a plurality of components. Such components, in their broadest context, include a toothpaste tube, a cap, and a housing. Each of the individual components is specifically configured and correlated one with respect to the other so as to attain the desired objectives.

The first component of the present invention is a toothpaste tube 14. The toothpaste tube has an elongated body portion 16 formed of a deformable material. Located within the body portion 16 is toothpaste for being dispensed. The body portion 16 has a closed bottom end 18 and an open top end 20. The top end includes a relatively rigid neck 22 with exterior male screw threads 24. The top end further includes an interior cylindrical bore 26 for the passage of toothpaste from the container to exterior thereof. Additionally, the toothpaste tube also has a shoulder 28. The shoulder is formed in a generally frusto-conical orientation and couples the lower end of the body portion by its radially exterior edge and the neck at its radially interior edge.

The next component of the present invention is a cap 32. The cap 32 is formed of a relatively rigid plastic material. The cap has a frusto-conical exterior surface 34 with a closed lower end 36 and an open upper end 38. A cylindrical recess 40 is formed with interior female screw threads 42 therein for removably coupling with the neck of the tube.

Lastly provided as a component of the present invention is a housing 46. The housing 46 is formed of a one-piece plastic construction. The plastic construction forming the housing is fabricated of a rigid material selected from the class of rigid materials including plastic, ceramic and metal, preferably plastic. The housing has a flat circular lower end 48 with a diameter of about 2.062 inches for being positioned securely on a counter. The housing further comprises a circular upper end 50 with a diameter of about 1.725 inches and with a frusto-conical exterior surface 52 therebetween and with a central bore 54 therethrough. The central bore has a vertical central axis with the exterior surface at an angle of between about 5 and 10 degrees from the vertical axis of the bore. Additionally, the central bore has a cylindrical lower part 56 of a reduced diameter of about 0.75 inches and a length of about 0.875 inches for receiving the toothpaste cap. The central bore also has a cylindrical upper portion 58 of an enlarged diameter of about 1.425 inches and a length of about 1.125 inches to receive a lower portion of the tube. Lastly, the bore has a frusto-conical intermediate section 60 of a length of about 0.150 inches between the upper and lower portions for receiving and supporting the shoulder 28.

The present invention includes a toothpaste tube and holder. The holder is positionable on a counter in an area of use for occupying minimum space. The holder supports the toothpaste tube in an inverted manner. This inverted manner allows the toothpaste to be in proximity to the cap for immediate dispensing and use upon removal of the cap and squeezing of the tube. The intermediate frusto-conical section of the holder provides an enlarged region for the shoulder of the tube to maximize support of the tube within the holder. An enlarged base abates the possibility of tipping of the tube when supported.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A support system in combination with an inverted toothpaste tube to insure ready dispensing of toothpaste from therewithin comprising, in combination:

a toothpaste tube having an elongated body portion formed of a deformable material with toothpaste therein for being dispensed, the body portion having a closed bottom end and an open top end, the top end including a relatively rigid neck with exterior male screw threads and an interior cylindrical bore for the passage of toothpaste from the container to exterior thereof, the toothpaste tube also having a shoulder in a generally frusto-conical orientation coupling the lower end of the body portion by its radially exterior edge and the neck at its radially interior edge;

a cap formed of a relatively rigid material having a frusto-conical exterior surface with a closed lower end and an open upper end and with a cylindrical recess formed with interior female screw threads therein for removably coupling with the neck of the tube; and a housing formed of a one piece construction, fabricated of a rigid material selected from the class of rigid materials including plastic, ceramic and metal, the housing having a flat circular lower end with a diameter of about 2.062 inches for being positioned securely on a counter and a circular upper end with a diameter of about 1.725 inches and with a frusto-conical exterior surface therebetween and with a central bore extending through the entire length of the housing, the bore having a vertical central axis with the exterior surface at an angle of between about 5 and 10 degrees from the vertical axis of the bore, the central bore having a cylindrical lower part with an open bottom of a reduced diameter of about 0.75 inches, slightly greater than the diameter of the toothpaste cap, and a length of about 0.875 inches for receiving the entire length of the cap and with the central bore having a cylindrical upper portion of an enlarged diameter of about 1.425 inches, slightly greater than the diameter of the body portion, and a length of about 1.125 inches to receive a lower portion of the tube and with the bore having a frusto-conical intermediate section of a length of about 0.150 inches between the upper and lower portions for receiving and supporting the shoulder.

2. The support system for an inverted toothpaste tube of the type having an elongated body portion and a neck of a reduced diameter and an intermediate frusto-conical shoulder there between and with a cap removably coupled to the neck, the system comprising a housing formed of a one piece construction, fabricated of a rigid material selected from the class of rigid materials including plastic, ceramic and metal, preferably plastic, the housing having a flat circular lower end for being positioned securely on a counter and a circular upper end and. with a frusto-conical exterior surface therebetween and with a central bore through the entire length of the housing, the bore having a vertical central axis with the exterior surface at an angle from the vertical axis of the bore, the central bore having a cylindrical lower part of a reduced diameter slightly greater than the diameter of the cap and a length greater than the length of the cap for receiving the entire length of the cap and with the central bore having a cylindrical upper portion of an enlarged diameter slightly greater than the diameter of the cylindrical lower part and slightly greater than the diameter of the body portion and a length to receive a lower portion of the body portion and with the bore having a frusto-conical intermediate section between the upper and lower portions for receiving and supporting the shoulder.

3. The support system for an inverted toothpaste tube of the type having an elongated body portion and a neck of a reduced diameter and an intermediate frusto-conical shoulder there between and with a cap removably coupled to the neck, the system comprising a housing formed of a one piece construction, fabricated of a rigid material selected from the class of rigid materials including plastic, ceramic and metal, preferably plastic, the housing having a flat circular lower end with a diameter of about 2.062 inches for being positioned securely on a counter and a circular upper end with a diameter of about 1.725 inches and with a frusto-conical exterior surface therebetween and with a central bore through the entire length thereof, the bore having a vertical central axis with the exterior surface at an angle of between about 5 and 10 degrees from the vertical axis of the bore, the central bore having a cylindrical lower part with an open bottom of a reduced diameter of about 0.750 inches, slightly greater than the diameter of the cap, and a length of about 0.875 inches, greater than the length of the cap, for receiving the entire length of the cap and with the central bore having a cylindrical upper portion of an enlarged diameter of about 1.425 inches, greater than the diameter of the diameter of the cylindrical lower part and sightly greater than the diameter of the body portion, and a length of about 1.125 inches to receive a lower portion of the body portion and with the bore having a frusto-conical intermediate section of a length of about 0.150 inches between the upper and lower portions for receiving and supporting the shoulder.

4. The system as set forth in claim 2 and further including a toothpaste tube having an elongated body portion formed of a deformable material with toothpaste therein for being dispensed, the body portion having a closed bottom end and an open top end, the top end including a relatively rigid neck with exterior male screw threads and an interior cylindrical bore for the passage of toothpaste from the container to exterior thereof, the toothpaste tube also having a shoulder in a generally frusto-conical orientation coupling the lower end of the body portion by its radially exterior edge and the neck at its radially interior edge and a cap formed of a relatively rigid plastic material having a frusto-conical exterior surface with a closed lower end and an open upper end and with a cylindrical recess formed with interior female screw threads therein for removably coupling with the neck of the tube.

* * * * *